United States Patent [19]

Shelton

[11] Patent Number: 4,902,167

[45] Date of Patent: Feb. 20, 1990

[54] LAND FILL FOR WASTE MATERIALS AND METHOD OF MAKING THE SAME

[75] Inventor: Paul G. Shelton, Hoffman Estates, Ill.

[73] Assignee: American Colloid Company, Arlington Heights, Ill.

[21] Appl. No.: 318,627

[22] Filed: Mar. 3, 1989

[51] Int. Cl.[4] ..... E02D 15/00

[52] U.S. Cl. ..... 405/128; 405/52; 405/129; 405/270

[58] Field of Search ..... 405/128, 129, 52, 53, 405/270, 54, 55, 258

[56] References Cited

U.S. PATENT DOCUMENTS

| | | | |
|---|---|---|---|
| 3,732,697 | 5/1973 | Dickson | 405/129 |
| 4,030,307 | 6/1977 | Avedisian | 405/270 |
| 4,166,709 | 9/1979 | Valiga | 405/128 |
| 4,222,685 | 9/1980 | Jefferson et al. | 405/270 |
| 4,362,434 | 12/1982 | Valiga et al. | 405/128 |
| 4,430,021 | 2/1984 | Wagner et al. | 405/129 |
| 4,501,788 | 2/1985 | Clem | 405/116 X |

*Primary Examiner*—Dennis L. Taylor

*Attorney, Agent, or Firm*—Mason, Kolehmainen, Rathburn & Wyss

[57] ABSTRACT

A land fill and method of containing solid wastes and/or waste fluids comprises placing the waste and/or waste fluids, either enclosed in a container, free flowing, solidified or treated, in a preformed cavity or pit that is excavated in a naturally occurring deposit of bentonite clay located adjacent or beneath the surface of the earth. The waste and/or waste fluid is of a type that will not pass through a bentonite layer that is left in its natural place after excavation thereby forming a natural liner or bottom wall of the excavated cavity. After the cavity or pit has been substantially filled with waste material, an overlayer of water-swellable bentonite may be provided on top of the mass of waste material and joining the liner wall around the outer peripheral edge to permanently enclose and seal-off the waste material, or the upper surface of the waste filled pit may be left uncovered.

8 Claims, 1 Drawing Sheet

LAND FILL FOR WASTE MATERIALS AND METHOD OF MAKING THE SAME

BACKGROUND OF THE INVENTION

1. Field of the Invention

The present invention relates to land fills and a method of forming a below ground receptacle or land fill for the storage and containment of solid and/or liquid waste materials. Many solid waste materials are capable of leaching out fluids during storage and containment, which fluids present hazards to the environment, especially when the leached out material comes in contact with ground water supplies.

More particularly, the present invention relates to a new and less costly method of containing waste liquids and leachable waste solids, including provision for the permanent storage of waste materials in a preformed pit that is formed as a result of the excavation or mining of a naturally occurring deposit of water-swellable, colloidal clay, such as bentonite-clay.

The storage of waste materials in a land fill cavity or pit that remains after mining and removal of water-swellable colloidal clay from the earth in accordance with the present invention makes use of a naturally compacted layer of clay which is left undisturbed in place and which layer provides an unexpectedly highly efficient, water-impermeable, natural pit liner that is highly economical, and durable for long periods of time. The naturally compacted bentonite layer eliminates the need for installing artificial or man-made bentonite liners and/or eliminating the need for installing plastic sheeting materials in a land fill pit prior to the storage and containment of waste material.

The laws and regulations issued by the EPA, RECRA and other State and Federal regulatory agencies are becoming increasingly more stringent and complex with respect to the lawful use of land fills for storing and containment of waste materials, particularly toxic waste materials, such as polychlorinated biphenyls, dioxins and the like. Burial of waste materials in the earth in the past has resulted in the leaching out of harmful materials, which materials sometimes pass through the soil bed beneath the originally introduced materials and eventually find their way into ground water supplies used for potable water, agriculture, and industry. When this does occur, both the soil and water supplies become contaminated with a resultant, almost immeasurable, human damage and economic cost. Regulations directed at land fills for highly toxic waste materials are now very stringent in order to make sure that the soil bed and water supplies beneath a land fill are permanently protected. These regulations generally do not permit the drainage or leaching out of any of the buried, potentially harmful, waste material in a land fill pit to pass through the soil bed below the land fill because of the possibility that these materials may eventually contaminate neighboring ground water supplies.

2. Description of the Prior Art

The present difficulties in the lawful burial, handling and containment of waste materials, particularly toxic materials, are well recognized and have resulted in alternative, and prohibitively expensive methods of waste material disposition, including recycling, waste-stream treatment, and incineration.

Land fill disposal of aqueous, or potentially aqueous, toxic substances typically requires systematically lining the surface area of a land fill cavity or pit with an artificially formed barrier of water-impermeable material, such as a layer of bentonite, or other water-swellable, colloidal clay, or a layer of bentonite laminated to one or more layers of an impermeable liner, such as polyethylene film so that toxic materials leaching out from the mass of waste material in the pit cannot penetrate through the artificially installed liner and eventually move into a ground water supply.

Bentonite clays have played an integral part in some land fill lining methods, as disclosed in U.S. Pat. Nos. 4,693,923 (McGroarty), 4,255,067 (Wright), 4,656,062 (Harriett), 4,501,788 (Clem), 4,344,722 (Blias), 3,986,365 (Hughes) and British Patent No. 1,029,513.

The McGroarty, Harriet, Wright, and British patents disclose a soil bed liner including a water-impermeable, polymeric material as an integral element thereof useful for waste material containment. The Harriet and McGroarty patents also disclose an additional or second, water-impermeable layer of bentonite clay particles adhered onto an impermeable polymeric liner. British patent No. 1,029,513 discloses the concept of providing a second layer of foamed plastic or resinous material filled with bentonite.

The Wright patent discloses a bentonite layer sandwiched between two sheets of 10–20 mil thickness, flexible, water-impermeable polymeric sheet material.

Blias U.S. Pat. No. 4,344,722 discloses a waterproofing article formed by a layer of bentonite particles sandwiched between two water-permeable membranes.

Clem U.S. Pat. No. 4,501,788 discloses the concept of adhering bentonite particles onto a vapor-permeable, non-biodegradable support.

Published European Patent Application No. 0059625 to Clem discloses a first layer of moisture-permeable, sheet material containing bentonite particles and having a plurality of layers disposed on both sides of the sheet.

The above-described patents generally disclose the concept of incorporating bentonite as an important element of the inventions thereof and, these patents generally teach or suggest that bentonite particles be adhered to both water-permeable or water-impermeable type flexible films or membranes. These membranes are also used to cover exposed, absorbent earth surfaces in a below-grade pit or containment area. The procedure of lining a large pit or excavation with a bentonite-containing waterproof liner is a relatively costly process and is not always completely effective because "breaks" often exist or form in an installed lining over time. Such breaks sometimes occur prior to, during or after the initial placement of the liner or during the deposition of waste materials into a previously lined pit.

Other approaches to the problem of providing water-impervious, flexible liners for land fill sites include the mixing of bentonite with native soil, the compacting of native soil and/or the mixing of clay with soil and a water-retaining polymer. For example, Hughes U.S. Pat. No. 3,986,365 discloses the concept of mixing equal parts of soil and bentonite and adding to this mixture a water-retaining polymer in order to retain water in a land fill.

OBJECTS OF THE INVENTION

Accordingly, it is an object of the present invention to provide a new and improved land fill for the storage and containment of waste materials, including toxic waste materials.

Another object of the invention is to provide a new and improved method of making a land fill for the storage and containment of waste materials.

Another object of the present invention is to provide a land fill formed by the careful excavation of a naturally occurring deposit of water-swellable, colloidal clay so as to leave undisturbed a water-impermeable layer of naturally compacted, water-swellable clay, thereby to form a natural liner for a pit designed to receive and hold waste material on a permanent basis.

Another object of the present invention is to provide a new and improved method of disposing of waste materials such as hazardous and toxic wastes, including the careful excavation of a naturally occurring deposit of water-swellable, colloidal clay in order to leave intact, a naturally compacted, water-impermeable bottom surface layer of bentonite clay of a desired thickness to hold the waste material and prevent liquids from leaching out or seeping into the earth below.

Another object of the present invention is to provide a land fill of the character described having a lower surface layer of naturally compacted, water-swellable, colloidal clay having a thickness or depth of at least 25 cm. or sufficient to provide a coefficient of permeability of less than about $1\times10-7$ cm/sec.

Another object of the present invention is to provide a new and improved land fill and method of making the same that is relatively low in cost, safe, efficient and reliable in operation and which requires little, if any, maintenance over a long useful life.

Yet another object of the present invention is to provide a new and improved land fill and method of making the same that provides efficient, permanent long term protection against damage to ground water supplies from liquid wastes and/or deleterious fluids that sometimes leach out of solid wastes and the like.

Still another object of the present invention is to provide a new and improved land fill and method of making the same which meets or exceeds the requirements of the EPA, and other Federal and State agencies for the permanent containment and storage of wastes and toxic materials.

SUMMARY OF THE INVENTION

In brief, the present invention is directed toward land fills for waste materials and to a method of forming such land fills for the permanent storage and containment of waste materials, particularly toxic waste materials, either in liquid or solid form. Water-swellable colloidal clay, such as bentonite clay, is found in naturally occurring deposits in the earth and after these deposits are mined and removed, a pit or excavated cavity is left in the earth's surface.

In accordance with the present invention, the mining or excavating operation is carefully conducted so as to leave an exposed surface layer of water-swellable, colloidal clay in the pit to remain after most all of the material in the pit has been mined and removed. This remaining layer of clay is left in a naturally compacted, undisturbed condition and has a depth or thickness obtaining over substantially the entire surface area of the pit of about 1" to 25 centimeters or greater depending on the waste material being handled.

After careful excavation has been completed, the open cavity or pit is especially suitable for the storage and containment of waste materials, including toxic waste materials and most importantly, the open pit requires little if any additional treatment in readiness for receiving waste material. The naturally formed and naturally compacted layer of water-swellable, bentonite that is left in place after the mining operation is completed, provides a liquid-impermeable, natural barrier for the pit ready to receive waste material. If during the excavation process, accidental cuts beyond and through the water-swellable layer of colloidal clay occur, these relatively small areas where the naturally deposited, desired thickness of the water-swellable, colloidal clay does not remain intact are treated, by adding compacted layers of bentonite clay, or a clay-polymeric sheet material which is laminated or otherwise secured into place.

The entire surface area of the open excavation or pit from a lowest point therein to an upper peripheral edge substantially adjacent the level of the surrounding earth is thus provided with a naturally compacted layer of water-swellable, colloidal clay, and waste material can then be introduced into the pit. The thickness of the layer of water-impermeable clay is selected so as to provide a coefficient of permeability of about $1\times10^{-7}$ cm/sec. and the selected thickness may vary somewhat dependent on the type of waste material to be stored and the applicable EPA and other regulations that obtain. The minimum thickness of the liquid-impermeable, naturally compacted layer of colloidal clay is usually at least 1 inch, up to about 25 cm. and may be as high as 1 foot or greater when the type of material and safety factors required dictate.

After the pit is substantially filled with waste material, the perimeter may be fenced off and secured, or an overlayer of water-swellable, colloidal clay may be deposited over the upper surface of the waste material and joined around a periphery thereof with the upper periphery of the underlying layer of naturally compacted bentonite clay in order to completely seal off the large mass of waste material in a substantially liquid-impervious barrier or envelope. Preferably, when an overlayer is in place, an upper surface thereof is crowned so as to direct moisture and water toward the outside of the periphery. After the overlayer is in place, a covering layer of ordinary earth may be provided, also with a crowned upper surface to shed moisture and water toward the undisturbed earth surrounding the periphery of the land fill.

BRIEF DESCRIPTION OF THE DRAWING

For a better understanding of the invention, reference should be had to the following detailed description, taken in conjunction with the drawings, in which.

DETAILED DESCRIPTION OF THE PREFERRED EMBODIMENTS OF THE INVENTION

Figure 1:
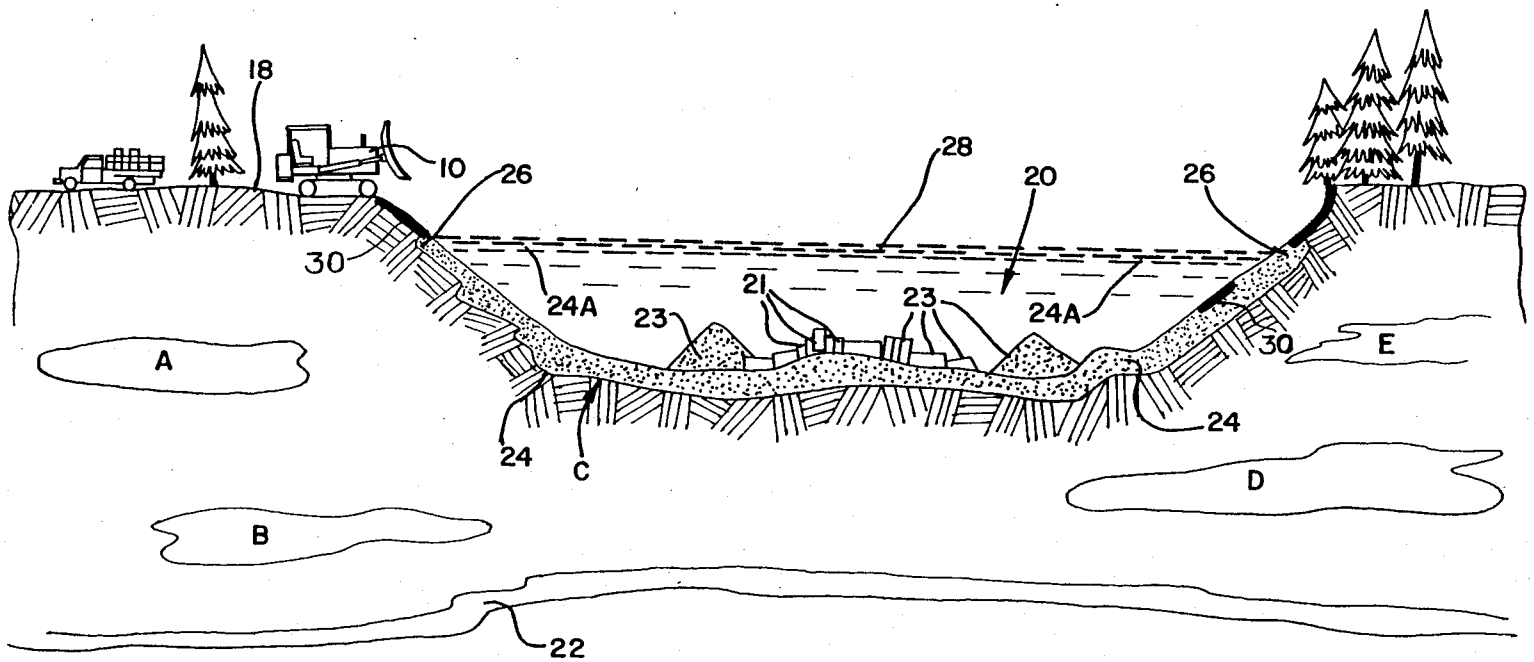
FIG. 1 is an elevational and vertical, crosssectional view of a new and improved land fill in accordance with the features of the present invention taken on a plane extending downwardly into the earth through the land fill and showing the land fill in a partially filled condition.

Water-swellable colloidal clays, such as bentonite clay, exist in naturally occurring deposits A, B, C, D, E, etc., located at or beneath the surface of the earth 18 in varying thicknesses and at various depths. The commercial recovery of bentonite from such deposits has long been practiced by excavating or strip mining the bentonite clay with large size, powerful excavating equipment such as a paddle wheel or front end loader, e.g. bulldozer. Many times these naturally occurring bentonite deposits are large in order to justify a mining operation and, accordingly, a pit depression or cavity 20 of considerable size is produced as a result of the excavating procedure, when substantially all of the bentonite has been removed.

For example, pits reaching 20 to 100 feet in depth, and a quarter mile to two miles long or in diameter are common. Depending on the size and location of a pit 20, it is sometimes necessary in order to comply with Federal and State mining and environmental regulations to reclaim the cavity, and leave the land in a better condition than before the mining of the bentonite occurred. The cost of refilling strip mines and cavities is sometimes extremely high and time-consuming because suitable fill material must be located, purchased and sometimes hauled by a truck or other conveyances over considerable distances to meet the stringent EPA requirements. At the same time, there exists a pressing need for suitable sites for the storage and containment of waste materials.

Toxic liquid wastes stored in drums 21 and various solid wastes 23 that are susceptible of leaching out hazardous substances that can eventually penetrate and contaminate ground water supplies lying beneath or closely adjacent to an excavation pit 20 must be properly contained and protected. If such materials are allowed to seep out or leak from a land fill site, a neighboring underground water supply 22 is in danger of contamination and poisoning.

In accordance with the principles of the present invention, it has been found that an open pit or cavity 20 created by the strip mining or excavating of a naturally occurring deposit of bentonite is well suited for the permanent storage and containment of waste materials. These pits are particularly well suited for hazardous and toxic materials of the type that tend to leach hazardous fluids when out rain water and melting snow are encountered. After the major amount of bentonite clay is mined and removed from a site, the remaining volume of bentonite clay is carefully mined and the excavation process is carried on in a precisely controlled manner so that only a relatively thin layer 24 of naturally compacted, water-swellable colloidal bentonite clay of a suitable thickness is left in place in an undisturbed condition. This layer 24 provides a natural barrier or pit liner that is impervious to the passage of liquids into the soil bed or earth below the pit 20.

As illustrated, the layer 24 of water-swellable, colloidal clay, in the large bentonite deposit "C" that remains after careful excavation in accordance with the present invention, begins to hydrate in the presence of water or other liquids and the bentonite material swells to form a continuous, water-impervious barrier extending from a lowest level in the pit 20 to an upper level 26 around a peripheral edge of the pit lying adjacent or below the level of the adjacent surface of the surrounding undisturbed earth 18.

In accordance with an important aspect of the present invention, a suitable colloidal clay for such land fill duty contains mainly bentonite clay. A preferred type of bentonite is sodium bentonite which is basically a hydratable montmorillonite clay of the type generally found in the Black Hills region of South Dakota and Wyoming having sodium as a predominant exchange ion. Other types of bentonite deposits that may be excavated to provide a land fill in accordance with the present invention may contain other cations such as magnesium and iron, and a suitable colloidal clay that may be utilized in the present invention may also comprise peptized bentonites. Other suitable water-swellable colloidal clays may comprise members of the dioctahedral or trioctahedral smectite group or mixtures thereof, and some examples are Beidellite, Nontronite, Hectorite and Saponite.

In situations where only relatively bland or non-toxic wastes are to be stored and contained in a land fill pit 20, the layer 24 of naturally compacted bentonite can have a thickness as low as 1 inch to provide a suitable safety factor and in cases where wastes of a more active nature are to be stored, the thickness of the layer 24 may range to 25 cm. up to 1 foot and even larger.

In determining the required thickness of the layer 24 that is needed, tests are run to establish the permeability coefficient of the existing layer of water-swellable material. In general, a thickness of material sufficient to provide a coefficient of permeability less than about $1\times10^{-7}$ cm/sec. is desirable for almost any types of wastes. In some situations where extremely hazardous wastes are involved, stored either in solid masses 23 or liquid containers, tanks, 21 and the like, a layer 24 of water-swellable, colloidial clay or bentonite having a thickness of about 1 foot is desirable to provide a higher factor of safety that is needed with these more hazardous fluids.

In all cases, after the general mining operations and final careful excavation have been completed, the surface area of the remaining intact and undisturbed layer 24 is closely inspected for trouble areas. In these trouble areas, the layers 24 may be of insufficient thickness or there may be patches of ordinary earth exposed that has no water-swellable bentonite present. Such trouble areas are indicated by the numeral 30 and are treated locally to attain the needed coefficient of permeability before the deposition of waste material begins. Treatment of these trouble areas (which are usually relatively small in size) is preferably accomplished in accordance with the system and process disclosed in the Clem U.S. Pat. No. 4,501,788.

Once the pit lining layer 24 is inspected and treated as necessary, waste materials such as liquid drums 21, masses and crates of solid wastes 23, or the like, are deposited into the open pit 20, by means of trucks, cranes, bulldozers, 10 and other types of equipment, depending on the depth and size of the pit. During the land fill operation, casual water from surface drainage, rain, snow and melting ice will be retained by the water-impervious, underlying, pit lining layer 24. As the pit 20 is filled, care is taken to insure that the pit lining layer 24 is not disturbed, broken and/or penetrated.

When the pit 20 is substantially filled with waste material and the upper level of the waste mass approaches the upper peripheral edge 26 of the water-impervious bentonite layer 24, further deposition of waste material is discontinued. The upper level of the waste deposition is spaced far enough below the level of the peripheral edge 26 so that drainage water, rain, snow and melting ice is retained. If the pit is to be left open, the water or moisture may evaporate without ever spilling or flowing-out over the edges of the pit 20. Usually open pits containing wastes must be fenced off and security is usually provided to prevent accidental or unauthorized entry into the area.

If desired and/or required, an overlayer 24A of water-impervious, liquid-swellable, bentonite clay, a plastic liner or a plastic/clay laminate of the desired thickness is laid down over the mass of waste material in the pit 20. This is done when the mass of waste is sufficiently dry and the overlayer 24A is joined around the periphery to the peripheral upper edge 26 of the pit lining layer 24 so as to completely seal off the mass of waste material against the further entry or egress of liquids. The upper surface of the overlayer 24A is crowned so as to shed water toward the periphery of the pit to eventually flow onto the adjacent surface of the surrounding earth 18.

In some instances where complete land restoration is required,. a layer of ordinary earth 28 is deposited over the mass of waste material in the pit 20 or on top of the overlayer 24A as the case may be, and this layer of earth also has a crowned upper surface to direct and shed water toward the periphery. A layer of grass or turf and other plantings may be provided to complete the land restoration and provide a surface area over the land fill pit 20 that is compatible with the surrounding earth 18.

Obviously, many modifications and variations of the invention as hereinbefore set forth can be made without departing from the spirit and scope thereof and therefore only such limitations should be imposed as are indicated by the appended claims.

What is claimed and sought to be secured by Letters Patent is:

1. A method of storing and containing waste materials within the earth to prevent pollution therefrom comprising the steps of:

excavating a quantity of water-swellable, colloidal clay from a naturally occurring deposit thereof to form a pit;

retaining a surface layer of naturally compacted, water-swellable, colloidal clay over substantially the entire area of said pit in an essentially undisturbed condition in a thickness sufficient to prevent permeation through said layer by said waste materials and fluids tending to leach therefrom; and placing waste materials on the top of said surface layer of said pit for eventually filling a substantial portion of the volume of said pit.

2. The method of claim 1 wherein the water-swellable colloidal clay is bentonite.

3. The method of claim 1, wherein:

said retained layer of naturally compacted, water-swellable, colloidal clay is retained at a thickness of at least 1 cm. above undisturbed earth below said pit.

4. The method of claim 1, wherein:

said retained layer of naturally compacted, water-swellable, colloidal clay is retained at a thickness of at least 1 inch above undisturbed earth below said pit.

5. The method of claim 1, wherein:

said retained layer of naturally compacted, water-swellable, colloidal clay is retained at a thickness of at least 1 foot above undisturbed earth below said pit.

6. The method of claim 1, including the step of:

forming an overlayer of water-swellable, colloidal clay above said waste material in said pit after said pit is substantially filled to seal said waste material in said pit below the surface of adjacent earth.

7. The method of claim 6, including the step of:

forming a layer of earth above said overlayer to have an upper surface substantially even with the surface of adjacent earth.

8. The method of claim 6, including the step of:

joining a periphery of said overlayer with an upper edge periphery of said layer to seal around said waste material in said pit.

* * * * *